US006050195A

United States Patent [19]

Diorio

[11] Patent Number: 6,050,195

[45] Date of Patent: Apr. 18, 2000

[54] SELF NEUTRALIZING FUZE

[75] Inventor: Frank Diorio, Lake Hopatcong, N.J.

[73] Assignee: The United States of America as represented by the Secretary of the Army, Washington, D.C.

[21] Appl. No.: 09/204,224

[22] Filed: Dec. 3, 1998

[51] Int. Cl.[7] ..... F42C 15/20

[52] U.S. Cl. ..... 102/257; 102/254

[58] Field of Search ..... 102/254, 255, 102/256, 257

[56] References Cited

U.S. PATENT DOCUMENTS

| | | | |
|---|---|---|---|
| 3,107,618 | 10/1963 | Vanover | 102/200 |
| 3,706,282 | 12/1972 | Lohmann et al. | 102/256 |
| 3,908,553 | 9/1975 | Beach | 102/254 |
| 4,007,689 | 2/1977 | Apotheloz | 102/251 |
| 4,393,780 | 7/1983 | Zacharin | 102/255 |
| 4,653,401 | 3/1987 | Gatti | 102/226 |
| 4,726,294 | 2/1988 | Apotheloz et al. | 102/255 |
| 4,915,028 | 4/1990 | Apotheloz | 102/238 |
| 5,387,257 | 2/1995 | Tari et al. | 102/226 |
| 5,670,736 | 9/1997 | Chemiere et al. | 102/254 |

*Primary Examiner*—Michael J. Carone
*Assistant Examiner*—James S. Bergin
*Attorney, Agent, or Firm*—John F. Moran; Michael C. Sachs

[57] ABSTRACT

A fuze self-neutralizing system is used for munitions having fuzes with spring-forced sliders (13) and stab detonators (19). The self-neutralizing components include an auxiliary battery (5), a auxiliary timing circuit (3) and a physical barrier (11) that prevents the firing pin (18) from contacting the stab detonator (19). Once the barrier (1) is in place, the munition can be handled with relative safety.

7 Claims, 4 Drawing Sheets

SELF NEUTRALIZING FUZE

U.S. GOVERNMENT INTEREST

The invention described herein may be made, used, or licensed by or for the U.S. Government for government purposes.

TECHNICAL FIELD

The present invention relates generally to safety devices used in munitions and sub-munitions. In particular, the present invention is directed to a self neutralizing feature which can be easily incorporated by modification to certain existing munitions and sub-munitions.

BACKGROUND ART

The problem of hazardous duds and of armed, but not triggered, munitions which have been tactically dispensed are well-known. Also, the safety hazards caused by accidental expulsion of explosive munitions have existed for a considerable amount of time. As a result substantial need exists for increased battlefield safety for U.S. and friendly forces advancing across munitions-contaminated battlefields. Innovations that decrease such hazards would result in significant cost savings for the activities normally associated with costly and time consuming battlefield clean-up tasks.

Additionally, serious munition hazards associated with shipboard accidents and accidental expulsion due to fire, etc. on-board flight decks constitute another serious problem. Expeditious clean-up of armed munitions would allow rapid reclamation of battlefields and rapid reuse of vital battle stations and flight decks. There are also substantial humanitarian reasons for deactivating unexploded munitions in areas once used as battlegrounds.

One example of a munition that suffers from the problem of accidental armed deployment is the M230/M231 fuze used on the sub-munitions of the 2.75 multi-purpose sub-munition (MPSM) Rocket Warhead. This munition contains a spring loaded (stored energy) firing pin, which can cause unintentional or accidental detonation of armed dud sub-munitions, such as the M73/M75, on the battlefield or upon accidental expulsion. This is also true for many other munitions and sub-munitions having a similar configuration.

As previously indicated, these conditions present serious safety hazards and result in very costly clean-up operations to reclaim battlefield areas for safe use. This situation has been addressed by the use of self-destruct fuzes in various types of munitions, as described in U.S. Pat. No. 5,387,257, incorporated herein by reference. This patent discloses a system in which a fuze will self-destruct electrically should the primary mechanical inertial device fail to operate upon striking an intended target. The self-destruct mechanism uses an auxiliary battery, an auxiliary timing device and an auxiliary explosive charge known as an Electro-Explosive Device (EED). This system is directed to the M230/M231 fuze for the M73/M75 sub-munition, as well as other munitions, such as the 105 mm DICM, XM915/XM916 projectile and the extended range MLRS (ER-MLRS).

However, accidental explosion of sub-munitions on board U.S. Naval Ships and Air Force flight decks or other installations present potentially more serious safety hazards to personnel, equipment and expensive weapon systems. Automatic detonation of a munition is not a viable option under such conditions. A self neutralizing (SN) feature which can easily be incorporated by a modification to the existing fuzes, such as those of the M230/M231 munitions could solve this problem. Unfortunately, simple modifications that would render armed munitions harmless are not addressed in the conventional art.

SUMMARY OF THE INVENTION

Accordingly it is an object of the present invention to provide a self-neutralizing munition that operates automatically after a predetermined amount of time, rending the munition safe.

It is another object of the present invention to facilitate the clean-up and removal of hazards from battlefields.

It is a further object of the present invention to provide a system by which armed munitions can be neutralized without explosions or other hazardous effects.

It is an additional object of the present invention to provide a system whereby existing munitions and sub-munitions can be easily modified to incorporate a self-neutralizing device.

It is again another object of the present invention to provide a system whereby existing munitions and sub-munitions can be modified for self-neutralization using existing components.

These and other objects and goals of the present invention are achieved by a self-neutralizing fuze in a munition where the munition is configured to include a main charge, a sliding detonation assembly having a stab detonator arranged to activate the main charge, a firing pin to impact the stab detonator when positioned by the sliding detonator assembly, and an arming device for aerodynamically enabling movement of the sliding detonator assembly. The self-neutralizing portion of the fuze includes a moveable barrier arranged to separate the firing pin from the stab detonator, and an actuator device for moving the moveable barrier into a position to stop the firing pin from impacting the stab detonator.

DETAILED DESCRIPTION OF THE PREFERRED EMBODIMENTS

Figure 4:
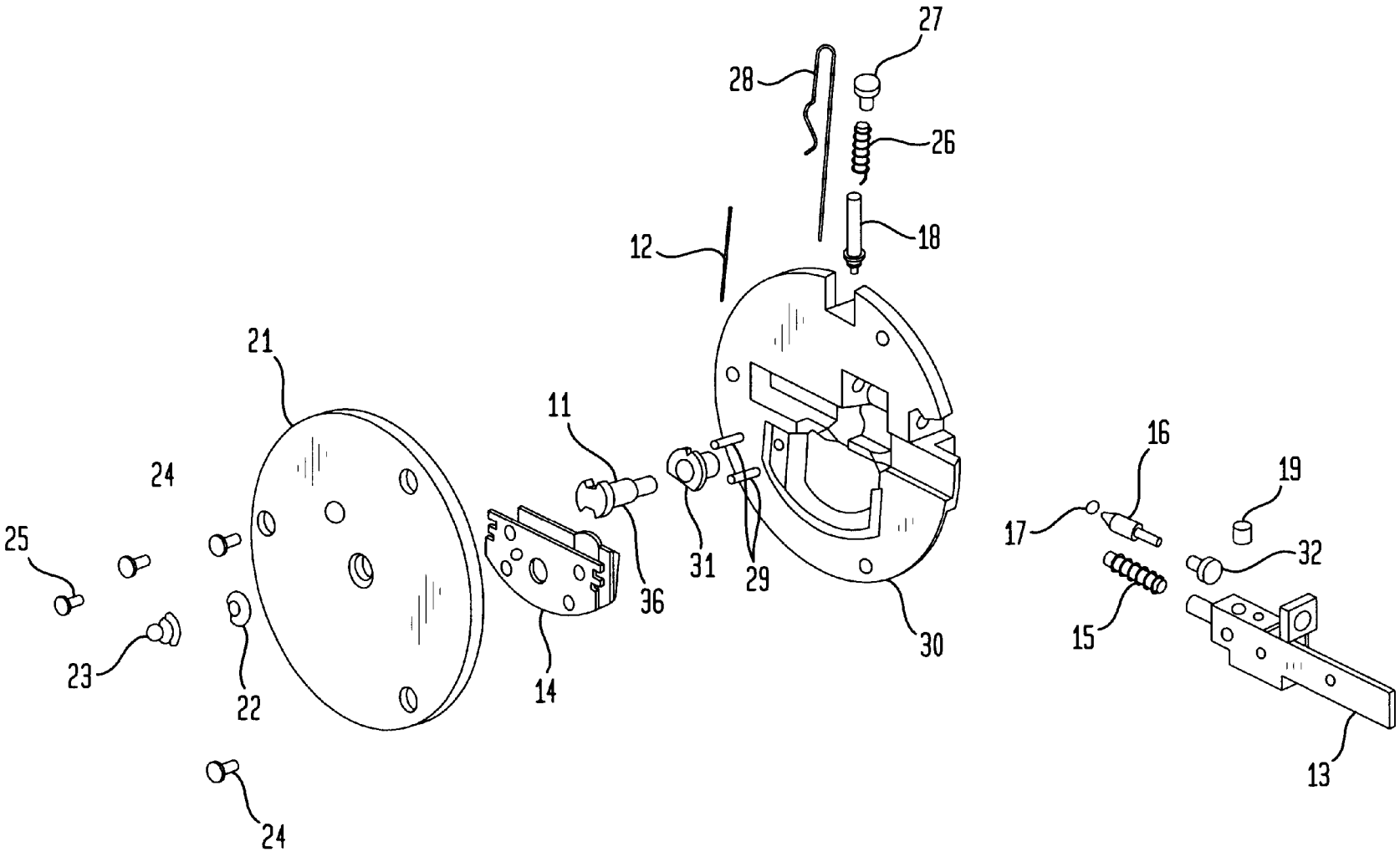
FIG. 4 is an exploded perspective diagram depicting a conventional fuze assembly.

The existing M230/M231 fuze design is depicted in FIG. 4. The self neutralizing (SN) capability is achieved by utilizing technology and components from the XM234/XM235 Self Destruct Fuze (SDF) depicted in U.S. Pat. No. 5,387,257. The key components of the SDF are the miniaturized reserve battery, the electronic IC timer/firing circuit chip and the Electro-Explosive Device (EED). The design and description of the SDF and these components are described by U.S. Pat. No. 5,387,257 with respect to the M230/M231 sub-munition, but can be used in any munition having a similar configuration.

The M73/M75 sub-munitions which contain the aforementioned fuze design are dispensed from the 2.75 inch rocket warhead. At ejection from the warhead, a ram air decelerator (RAD) (not shown), a high drag device, generates a high wind drag force(chute shock) when the munition hits the air stream. This drag force acts on the arming pin 11, which is held in the safe position by a shear wire, 12 which is mounted in a hole 36 going through the arming pin. When the arming pin travels upward shearing wire 12 by the pull of the RAD, it frees the interlock 35 of the arming pin on the slider 13.

The slider 13 is then free to move, retarded only by the escapement mechanism 14 (timer subassembly), to the in-line position of stab detonator 19 and firing pin 18. Movement of the slider also allows release of the pivoting end of the trigger 16. The fuze is now in the armed condition to function upon ground or target impact causes the triggering mass to pivot which releases the locking detent ball 17 holding back the firing pin 18. The firing pin under spring 26 loading then stabs the M55 detonator 19 in the slide, which then propagates to the lead cups 22,23, and finally to the main charge (not shown) delivering its lethal effects. The other elements of the M230 fuze depicted in FIG. 4 are all well-known to practitioners in this art, and require no further elaboration.

Figure 1:
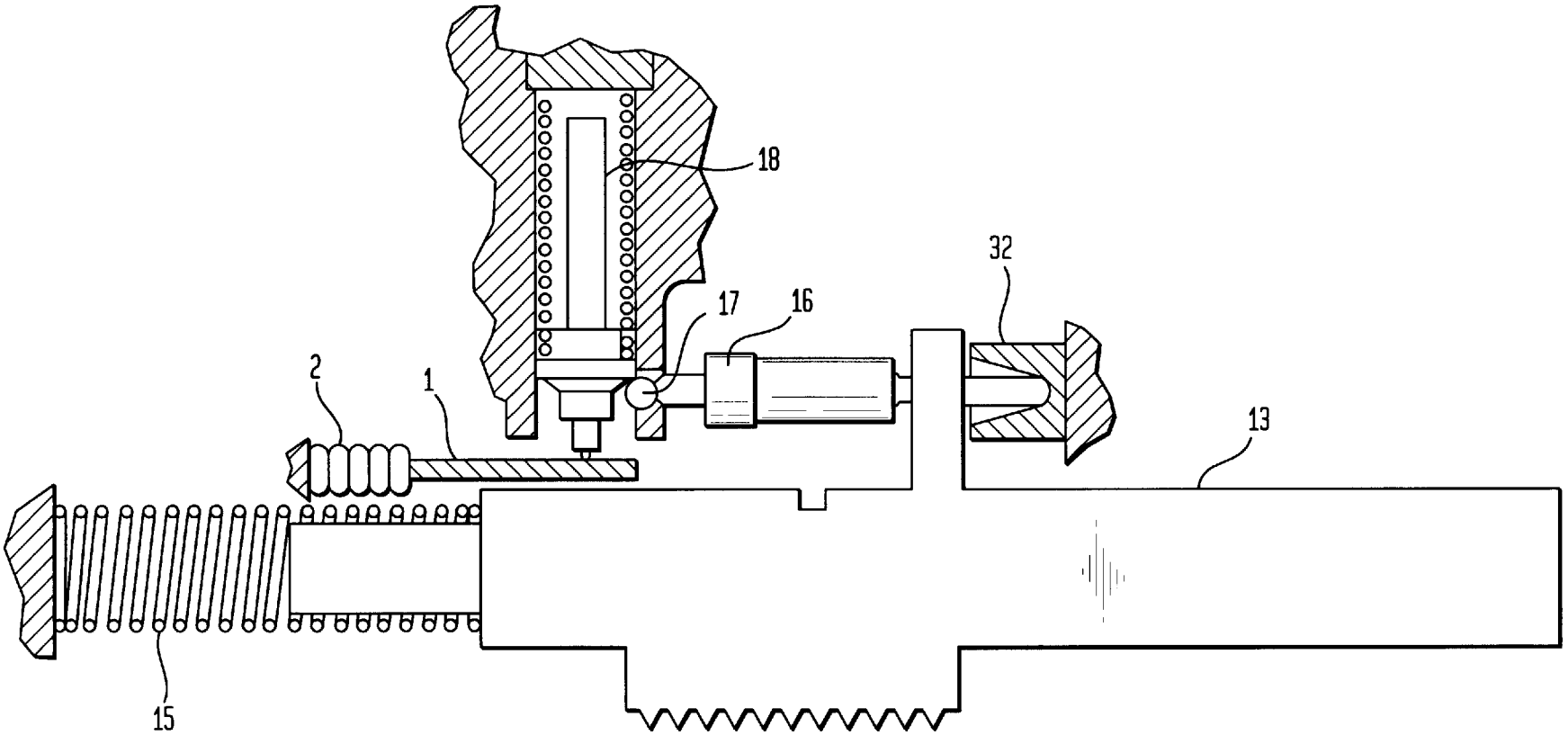
FIG. 1 is a sectional side-view diagram depicting a triggering mechanism as modified by the present invention in a deployed state.
Figure 2:
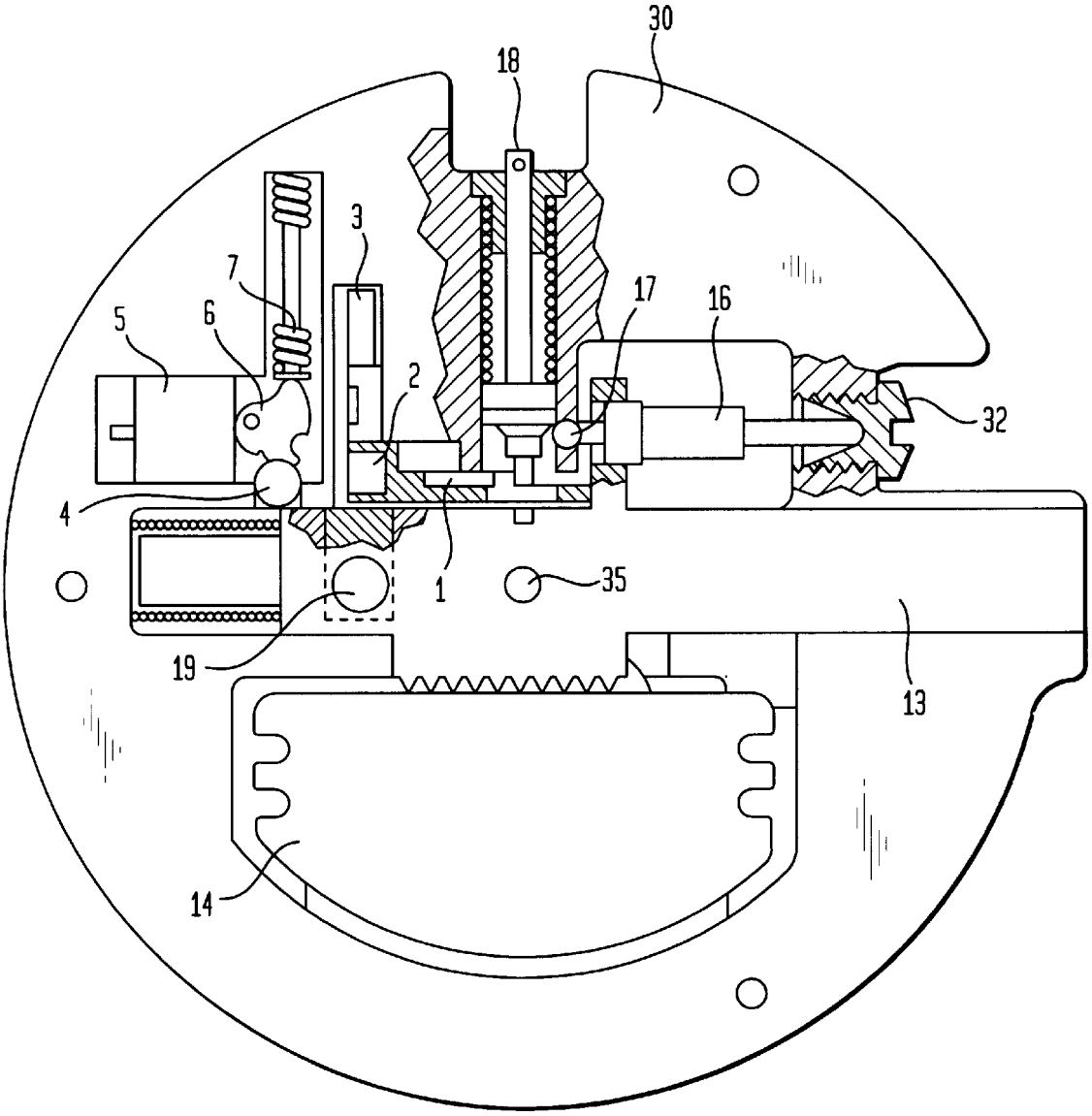
FIG. 2 is a sectional side-view diagram depicting an entire fuze assembly modified according to the present invention.
Figure 3:
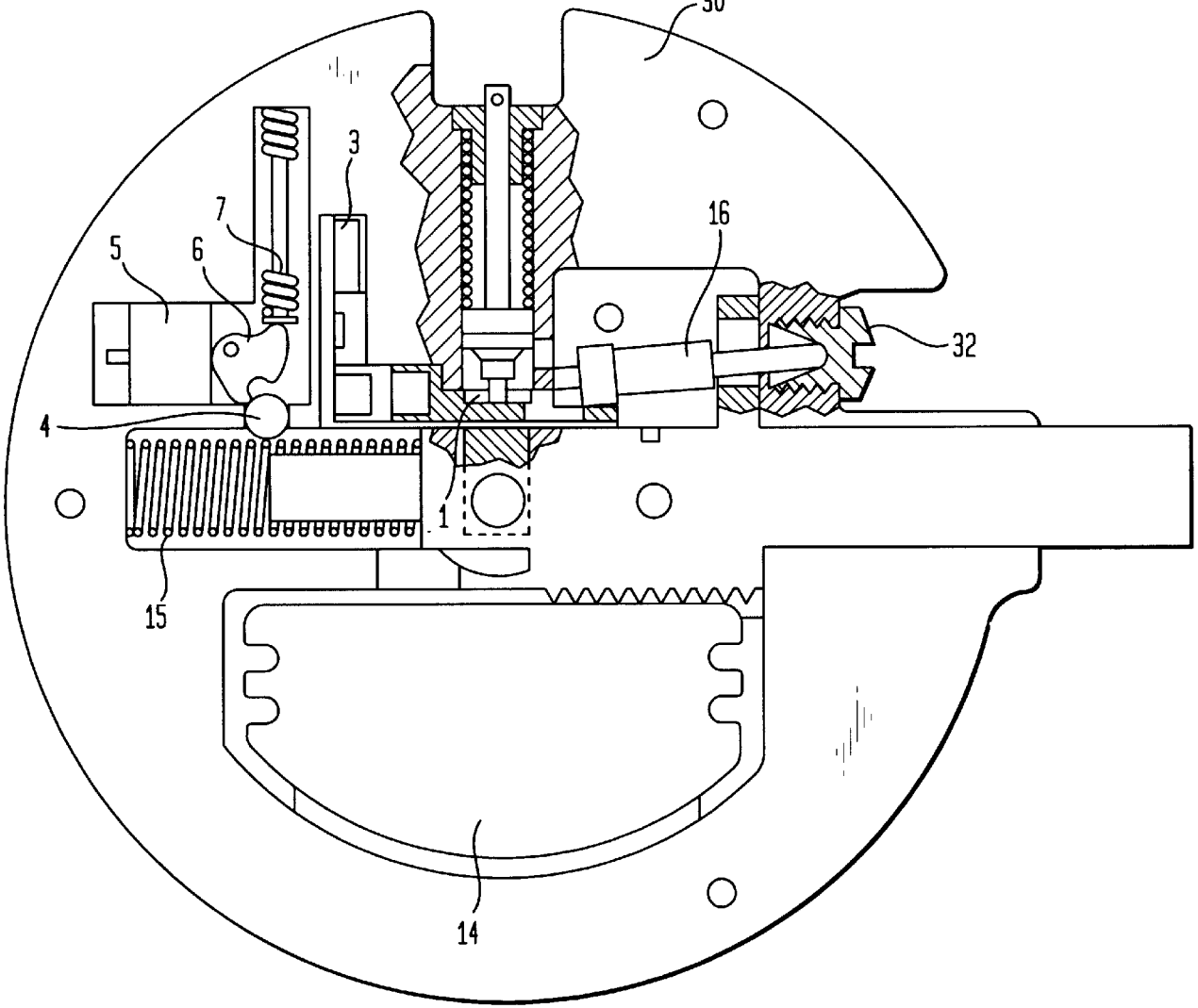
FIG. 3 is a sectional side-view diagram depicting the operation of the present invention.

Intergration of these components are utilized to move a physical barrier, or interrupter 1 (as illustrated in FIGS. 1–3), between the spring-loaded firing pin 18 and the stab detonator 19 to preclude the firing pin from stabbing the detonator, if a spurious or unintentional stimulus releases the arming pin 11. The physical barrier will be moved into this position by an electro-actuator device (EAD) 2 when an initiation signal is generated by the timer/firing circuit chip located on the electronic printed circuit card 3. This will occur within approximately 3 minutes after expulsion of the munitions under conditions in which the arming safety (arming pin 11) has been defeated. This timing can be adjusted to more or less if desired by conventional manipulation of the timer circuit on circuit card 3.

The EAD 2 is a modified EED component of the SDF of U.S. Pat. No. 5,387,257. The modification for the present invention provides mechanical motion output instead of explosive output by modifying the energetic material to burn at a rate which builds pressure rather than denoting and yielding an explosive characteristic. The mixture of the EAD 2 constitutes a conductive, non-explosive mix which has graphite particles forming a path throughout the mixture to conduct electricity therethrough. This acts as an electrical bridge for generating the energy necessary to quickly move the moveable physical barrier without damage to the barrier or the surrounding fuze.

The conductive non-explosive combustible mix of EAD 2 includes a barium nitrate oxidizer, a calcium silicide fuel, a conducting material such as graphite and an energetic material such as lead styphnate. This mixture is very similar to that disclosed in U.S. Pat. No. 5,387,257, but with modifications well known to practitioners in the explosives art to limit the speed of combustion so that an explosion does not occur. Rather, combustion is to take place only rapidly enough to quickly move the moveable physical barrier between the firing pin 18 and the stab detonator 19.

The self-neutralizing feature is activated after the safety shear wire 12 through hole 36 in the arming pin 11 is either intentionally or unintentionally defeated. The same motion of the arming pin which frees the slider 13 will free the locking detent ball 4 restraining the actuation lever 6 of auxiliary battery 5. Once the battery is actuated, the IC timer, firing circuit and associated integrated electronics used by the system of U.S. Pat. No. 5,387,257 for the XM234/XM235 SDF and located on the printed circuit card 3 operate in the same manner for the present invention. At the end of the approximately 3 minute delay generated by the timing circuit of circuit card 3, a pulse from a firing circuit located on circuit card 3 triggers EAD 2.

The circuit card contains an integrated circuit electrically coupled the auxiliary battery 5. The integrated circuit includes an oscillator and a voltage quadrupler used to provide output triggering signal after a predetermined time interval. Circuit card 3 also includes a firing capacitor charged by the auxiliary battery 5, and electrically coupled to the output of the integrated circuit for initiating EAD 2.

The auxiliary battery 5 is of the same type used in the device of U.S. Pat. No. 5,387,257. The battery includes a metal housing and a cylindrical cathode made of carbon black/teflon material located adjacent to an electrical contact with the housing. Also included is a cylindrical separator operatively disposed within the cathode cylinder. A cylindrical anode made of nickel/lithium material is operatively disposed within the cylindrical separator and mechanically isolated from the cathode by the separator. A sealed glass ampule contains thionyl chloride electrolyte. The ampule is operatively positioned in the auxiliary battery housing to break and release the electrolyte when the spring loaded lever actuator 6 is aerodynamically released.

The EAD 2 is effectuated by proper modification of the EED of U.S. Pat. No. 5,387,257 to carry out combustion at a non-explosive rate. This would still create sufficient force and sufficient speed to impart mechanical motion to the interrupter 1. The interrupter would then provide a physical barrier to the firing pin, preventing it from stabbing the M55 detonator, 7 thus neutralizing the fuze in the event that the munition resulted in a dud after firing, or became armed as a result of an unintentional or accidental dispensing at a munition installation. Because the spring loaded firing pin 18 is interpreted or precluded from stabbing the M55 detonator 19 on the slide, 13 the munition would be safe to handle by trained personnel.

Although at least one embodiment of the present invention has been presented by way of example, the present invention should not be limited thereby. Rather, the present invention should be interpreted as encompassing all modifications, variations, adaptations, permutations and other embodiments that would occur to one skilled in this art who has been taught the present invention by this application. Consequently, the present invention should be construed as being limited only by the following claims.

I claim:

1. A self-neutralizing fuze in a munition configured to include (i) a main charge, (ii) a sliding detonation assembly having a stab detonator arranged to activate said main charge, (iii) a firing pin arranged to impact said stab detonator when positioned by the sliding detonator assembly and, (iv) arming means for aerodynamically enabling movement of said sliding detonator assembly, said self-neutralizing fuze comprising:

(a) a moveable barrier arranged to separate said firing pin from said stab detonator; and, (b) actuator means for moving said moveable barrier into a position to stop the firing pin from impacting said stab detonator.

2. The self-neutralizing fuze of claim 1, further comprising:

(a) timing means for generating a triggering signal; and, (b) initiating means for activating said actuator means responsive to said triggering signal.

3. The self-neutralizing fuze of claim 2, wherein said initiating means comprise:

(a) a reserve battery operatively disposed on said sliding detonator assembly; and, (b) a spring loaded lever actuator operatively placed adjacent to said reserve battery for initiating said reserve battery when said arming means enables movement of said sliding detonator assembly.

4. A self-neutralizing fuze as recited in claim 3, wherein said timing means comprises:

(a) an integrated circuit electrically coupled to said reserve battery, said integrated circuit having an oscillator and voltage quadrupler therein for providing a firing output signal after a fixed time interval; and, (b) a firing capacitor charged by said reserve battery and electrically coupled to the output of said integrated circuit for initiating said actuator means.

5. A self-neutralizing fuze as recited in claim 4, wherein said actuator means comprises a conductive non-explosive mix which has graphite particles forming a path therein which conduct electricity therethrough and acts as an electrical bridge to generating energy necessary to move said moveable barrier.

6. A self-neutralizing fuze as recited in claim 5, wherein the conductive non-explosive mix includes:

(a) a barium nitrate oxidizer, (b) a calcium silicide fuel, (c) a graphic conducting material and, (d) a lead styphnate energetic material, in proportions for non-explosive combustion.

7. A self-neutralizing fuze as recited in claim 6, wherein said reserve battery includes:

(a) a metal battery housing;

(b) a cylindrical cathode of carbon black/teflon material located adjacent to and in electrical contact with said housing;

(c) a cylindrical separator operatively disposed within said cathode cylinder;

(d) a cylindrical anode made of nickel/lithium material operatively disposed within said separator and mechanically isolated from said cathode by said separator; and, (e) a sealed glass ampule containing thionyl chloride electrolyte therein, said ampule operatively positioned in said reserve battery housing to break and release said electrolyte when said spring loaded lever actuator is aerodynamically released.

* * * * *